US005460714A

United States Patent [19]

Fixari et al.

[11] Patent Number: 5,460,714

[45] Date of Patent: Oct. 24, 1995

[54] LIQUID PHASE CATALYTIC HYDROCARBON HYDROCONVERSION WITH POLYAROMATIC ADDITIVE

[75] Inventors: Bernard Fixari, Vienne; Pierre Le Perchec, Lyons; Jeanne Elmouchnino, Montrouge; Frederic Morel, Sainte Foy Les Lyon; Martine Boulinguiez, Villeurbane, all of France

[73] Assignees: Institut Francais du Petrole, Rueil Malmaison; Elf Antar France, Paris LaDefense, both of France

[21] Appl. No.: 37,111

[22] Filed: Mar. 25, 1993

[30] Foreign Application Priority Data

Mar. 26, 1992 [FR] France ..... 92 03660

[51] Int. Cl.[6] ..... C10G 47/06

[52] U.S. Cl. ..... 208/112; 208/108; 208/420; 208/56

[58] Field of Search ..... 208/56, 108, 112, 208/145, 420

[56] References Cited

U.S. PATENT DOCUMENTS

| | | | |
|---|---|---|---|
| 4,134,825 | 1/1979 | Bearden, Jr. et al. | 208/108 |
| 4,244,839 | 1/1981 | Aldridge et al. | 208/420 |
| 4,292,168 | 9/1981 | Derbyshire et al. | 208/107 |
| 4,485,004 | 11/1984 | Fisher et al. | 208/112 |
| 4,857,168 | 8/1989 | Kubo et al. | 208/108 |
| 4,966,679 | 10/1990 | Kubo et al. | 208/145 |

FOREIGN PATENT DOCUMENTS

| | | |
|---|---|---|
| 1031914 | 6/1958 | Germany . |
| WO90/05587 | 5/1990 | WIPO . |

*Primary Examiner*—Asok Pal
*Assistant Examiner*—Walter D. Griffin
*Attorney, Agent, or Firm*—Millen, White, Zelano & Branigan

[57] ABSTRACT

The invention involves the liquid phase hydroconversion of hydrocarbon charges containing heavy fractions, and more particularly their deep conversion, in which the charge is contacted with a dispersed catalyst in the presence of a polyaromatic additive. The catalyst is a sulfide of a hydrogenating metal (such as molybdenum, nickel or cobalt) generated in situ from a precursor. The additive has at least three aromatic cycles, has a boiling point exceeding 300° C., and is added at a rate of 5 to 60% by weight based on the charge. Synergism between the catalyst and the additive makes it possible to reduce the catalyst quantity and/or improve the conversion and quality of the products.

13 Claims, No Drawings

LIQUID PHASE CATALYTIC HYDROCARBON HYDROCONVERSION WITH POLYAROMATIC ADDITIVE

BACKGROUND OF THE INVENTION

The invention relates to a process for the liquid phase hydroconversion of charges containing heavy fractions, particularly heavy hydrocarbons and more specifically relates to their deep conversion.

Non-catalytic processes exist and among these a process described in U.S. Pat. No. 4,292,168 uses a hydrogen donor solvent at 350° to 500° C. and under 2 to 18 MPa. It is possible to choose as solvents pyrene, fluoroanthene, anthracene, etc., their nitrogen derivatives, their hydrogen derivatives and their short-chain alkyl derivatives. The latter non-catalytic process operates well in the case of moderate conversions. However, when it is wished to reach higher conversion levels (beyond 50%) and even deep conversions (beyond 70%), the conditions are more severe and then larger coke quantities form.

The prior art describes at length (e.g. in U.S. Pat. No. 4,134,825) that unlike in the case of supported catalysts, finely divided catalytic species obtained from a precursor, in the form of a metal complex soluble in an aqueous, alcoholic or organic medium, are able to ensure the hydroconversion under satisfactory conditions without being limited by deactivation and poisoning phenomena encountered with conventional catalysts.

Thus, in the past, it has been possible to obtain under hydrovisco reduction conditions in the presence of this type of catalyst up to and exceeding 50% conversion of heavy fractions into lighter fractions without excessive coke formation. However, as a function of the nature of the charges, the performance characteristics often remain limited in the deep conversion range.

One means for improving the performance characteristics is to operate in the presence of a larger catalyst quantity, but then the costs are higher. Another means is to significantly increase the hydrogen pressure, which involves the use of specially adapted and expensive equipment. One aim of the invention is to avoid the use of such catalyst quantities and such hydrogen pressure levels for obtaining better performance characteristics.

SUMMARY OF THE INVENTION

More specifically, the present invention relates to a process for the liquid phase hydroconversion of charges containing heavy fractions having a boiling point exceeding 370° C., in the presence of a dispersed catalyst comprising a metal sulphide generated in the reaction medium from a precursor, characterized in that at least one polyaromatic additive having a boiling point between 300° and 550° C. and having at least three aromatic cycles is added to the reaction medium at a rate of 5 to 60% by weight based on the charge, the catalytic metal chosen from among hydrogenating metals being introduced at a rate of 50 to 5000 ppm based on the charge and the pressure is set at above 3.5 MPa and the temperature at at least 400° C. for a sufficiently long time to convert at least 50% of the heavy fractions.

The charge to be treated contains a majority of products having a boiling point exceeding 370° C. and contains heavy fractions, in particular asphaltenes.

The charge is generally an atmospheric distillation residue (boiling point above 370° C.), a vacuum distillation residue (boiling point above 500° C.) or a heavy petrol having a significant asphaltene proportion. Petrol/charcoal mixtures can also be treated.

The invention is particularly advantageous with charges containing heavy fractions with a boiling point above 500° C. for the conversion of which more severe conditions are necessary.

The dispersed catalysts used are described in the prior art. The catalyst is constituted by a sulphide of a hydrogenating metal, chosen from within the group formed by metals of groups IV B, V B, VI B, VII B and VIII of the periodic classification of elements and more particularly metals from groups VI B, VII B and VIII. Preferably, the metal is molybdenum, nickel or cobalt. These metals can be combined with one another or with other metals from other groups (e.g. Mo or Fe). The catalyst is generated in the reaction medium from a precursor, which is preferably an oxide or a salt of an organic acid, such as e.g. an octoate, a naphthenate or a polyacid. The most widely used metal is molybdenum and its precursor is phosphomolybdic acid (PMA) or molybdenum naphthenate.

The precursor is introduced in solution form into a solvent chosen from within the group formed by water, alcohol, organic solvents and their mixtures. It generates a dispersed metallic species (e.g. $MoO_3$ generated by PMA), which is sulphurized either by the charge or by a sulphurizing agent before or after contacting with the charge. All known sulphurizing agents can be used.

According to the invention, an additive is added to the reaction medium (constituted at least by the charge, the catalyst and hydrogen). The additive is a polyaromatic compound containing at least three aromatic rings and whose boiling point is between 300° and 550° C. Pyrene, fluoroanthene, anthracene, benzanthracene, dibenzanthracene, perylene, coronene and benzopyrene are suitable. Their alkyl derivatives can also be used, provided that they have short alkyl chains (e.g. ethyl or methyl).

Certain petroleum fractions with a boiling point between 300° and 550° C. are of particular interest, because they contain a high proportion of aromatics with more than three rings. The 400° to 500° C. fraction is particularly advantageous, in that it contains on a majority basis polyaromatics with 4 to 5 rings. This is the case with decanted liquid heavy phases obtained from catalytic cracking and referred to as slurry, whereof a typical composition is given in the examples.

The additive is introduced at a rate of 5 to 60% by weight, based on the charge and usually between 10 and 50%. The catalytic metal quantity present represents 50 to 5000 ppm of the charge. The additive is added to the reaction medium of the reactor or prior to introduction into the reactor in which the process takes place.

The process temperature is at least 400° C. and is preferably between 430° and 450° C. The pressure is at least 3.5 MPa, is preferably above 5 MPa and is generally between 10 and 15 MPa. Under these conditions, the residence time of the charge in the reactor is adequate to permit the conversion of at least 50% of the heavy fractions.

To obtain a deep conversion (>70%), the pressure will be set at above 5 MPa and generally at more than 10 MPa. The residence time ranges between one and several hours.

It has been found that, under these conditions, the conversion of the heavy fractions is surprisingly significantly improved without supplemental coke formation. A synergism between the catalyst and the additive has been revealed, as is illustrated by the following, non-limitative examples.

EXAMPLES

Tests have been carried out on the Saudi Arabian Safaniya vacuum residue, whose main characteristics are summarized in the following Table O.

Phosphomolybdic acid (PMA) of formula 12 $MoO_3$, $H_3PO_4$, $xH_2O$ used contains (by weight) 46.86% molybdenum, 2.81% phosphorus, 2.41% hydrogen and 44.92% oxygen. For 100 g, this corresponds to the presence of 0.52 mole of $MoO_3$, 0.09 mole of $H_3PO_4$ and 0.89 mole of $H_2O$.

TABLE 0

Characteristics of Safaniya vacuum residue.

| | | |
|---|---|---|
| Relative density 25/25 | — | 1.035 |
| Viscosity at 100° C. | $m^2/s$ | $5660 \times 10^{-4}$ |
| Viscosity at 150° C. | $m^2/s$ | $292 \times 10^{-4}$ |
| H | wt. % | 10.07 |
| C | wt. % | 84.51 |
| H/Cat | — | 1.43 |
| Sulphur | wt. % | 5.43 |
| Total nitrogen | ppm | 4100 |
| n-$C_5$ asphaltenes | wt. % | 25.6 |
| n-$C_7$ asphaltenes | wt. % | 14.7 |
| Conradson carbon | wt. % | 21.5 |
| Nickel | ppm | 45 |
| Vanadium | ppm | 155 |
| Simulated distillation (D2887) | °C. | |
| PI | | 287 |
| 5 wt. % | | 487 |
| 10 | | 518 |
| 20 | | 562 |
| SARA analysis | | |
| Asphaltenes | wt. % | 14.7 |
| Saturated products | wt. % | 9.8 |
| Aromatics | wt. % | 48.9 |
| Resins | wt. % | 26.6 |

The reactor used is an autoclave with a volume of 350 $cm^3$ and having a stainless steel bucket, equipped with a magnetic stirrer and whose maximum use pressure is 15 MPa. Bucket heating takes place by immersion in a nitrogen-fluidized sand bath. Two sensors record the temperature and pressure profiles within the bucket during the rise, plateau and part of the cooling.

The charge (approximately 30g) is introduced into the bucket following slight heating in the oven (120° C. —45 min.), so as to reduce the viscosity. The PMA is added after cooling to 60° to 80° C. The reactor is sealed and purged with hydrogen in order to eliminate all traces of air. The pressure is then adjusted to the chosen level. The sand bath is preheated for approximately 2 hours before immersing the bucket in order to obtain a homogeneous temperature and a rise time up to the pyrolysis temperature between 10 and 15 minutes. In less than 2 minutes, the reaction medium reaches 200° C. The start of cracking temperature of 350° C. is obtained approximately 5 minutes after immersion. Following the temperature plateau, the mixture is cooled with the aid of a strong current of compressed air. The mixture temperature is again brought to 350° C. in 2 to 5 minutes. The reactor is depressurized at 25° C.

The gas fraction G is not recovered, but its quantity is determined by subtraction between the initial weight used and the weight of the liquid and solid effluents. The liquid phase L generally constitutes most (by weight) of the overall formulation. The solid phase corresponds to the insoluble fraction in hot benzene. This solid is separated by filtration (filter paper) and successive washing operations until a clear rinsing solution is obtained in the ultrasonic tank. The thus obtained solid contains the molybdenum-based, active catalytic species created in situ, plus the coke. The coke weight C formed is obtained by subtracting the catalyst weight from the solid weight. The catalyst weight is estimated by hypothetically assuming a total sulphurization of molybdenum into $MoS_2$. Its contribution is negligible for the tests performed with 1400 ppm of Mo.

Analysis by oxidizing pyrolysis of the liquid phase, such as is e.g. described in European patent application EP-A-269, 511 makes it possible to determine the conversion of the fraction of the charge having a boiling point exceeding 500° C. into a fraction having a boiling point below 500° C. (Y500); the conversion of the fraction having a boiling point above 650° C. into a fraction with a lower boiling point (Y650); the residual carbon percentage CR in the liquid; and the atomic H/C (hydrogen/carbon) ratio.

Table I shows that the addition of 10% pyrene jointly to the PMA is sufficient for markedly reducing coke production (from 7% for JE 65 or 12.7% for JE 108 to 2.6% for JE 76) and clearly shows the conversion of the initial residual carbon (32% for JE 65 to 44.6% for JE 76, figures not given in the table).

There is also a rise in the residual carbon level CR of the liquid (from 3.7% for JE 65 or 4.8% for JE 108 to 6.7% for JE 76). It is probable that this rise results from pyrene fixing to the petrol or the maintaining of the coke precursors in the liquid phase.

These experimental observations demonstrate the existence of a synergism between the dispersed "Mo" and the pyrene. The results obtained with the combination in question are better than the sum of the effects recorded with the compounds used separately. Thus, the results for JE 76 (PMA+10% pyrene) are similar to those for JE 67 (5000 ppm Mo) performed under isoseverity conditions (430° C.—2 hours).

The addition of 20% pyrene (JE 111) leads to marked reductions of the coke level and conversions. It would also appear that an excessive pyrene quantity is less effective for the quality of the transformation, as is confirmed by test JE 71 performed with 50% polyaromatic additive.

TABLE I

| | Comparative | | | Invention | | | Comparative |
|---|---|---|---|---|---|---|---|
| | JE78 | JE65 | JE108 | JE76 | JE111 | JE71 | JE67 |
| Conditions: | | | | | | | |
| pyrene (%) | 0 | 0 | 10 | 10 | 20 | 50 | 0 |
| PMA (ppm Mo) | 0 | 1400 | 0 | 1400 | 1400 | 1400 | 5000 |
| Initial P H2 (25° C.) (MPa) | 7.5 | 7.5 | 7.5 | 7.5 | 7.5 | 7.5 | 7.5 |
| Temperature (°C.) | 430 | 430 | 430 | 430 | 430 | 430 | 430 |
| Residence time (mn) | 120 | 120 | 120 | 120 | 120 | 120 | 120 |
| Weight balance (pyrene deducted): | | | | | | | |
| G (%) | 14.7 | 10 | 11.7 | 9.5 | 8.4 | 9.6 | 8.3 |
| L (%) | 69.9 | 83 | 75.6 | 87.9 | 90.4 | 89.4 | 88.5 |
| C (%) | 15.4 | 7 | 12.7 | 2.6 | 1.2 | 1.0 | 3.2 |
| Conversions (pyrene deducted): | | | | | | | |
| Y500 (%) | 65.2 | 68.7 | 68.4 | 65.8 | 56.5 | 53.4 | 67.1 |

TABLE I-continued

| | Comparative | | | Invention | | | Comparative |
|---|---|---|---|---|---|---|---|
| | JE78 | JE65 | JE108 | JE76 | JE111 | JE71 | JE67 |
| Y650 (%) | 59.5 | 75.7 | 62.9 | 77.6 | 66.1 | 66.2 | 80.3 |
| Liquid quality (pyrene deducted): | | | | | | | |
| Quantity of 500 (%) | 75.3 | 73.1 | 76.7 | 65.7 | 44.9 | 51.1 | 67.5 |
| Cr (%) | 4.4 | 3.7 | 4.8 | 6.4 | 11.5 | 11.5 | 5.6 |
| H/C at | 1.42 | 1.45 | 1.40 | 1.37 | 1.35 | 1.36 | 1.54 |

The increase of the residence time (JE 115°: 430° C.—3 hours), illustrated in Table II, reveals that the 10% pyrene, even at this severity level, produce an anticoking effect. Thus, the result is relatively satisfactory despite the progression of the coke level from 2.6 to 6.1 (pyrene deducted). Thus, the results of this test are close to those for SD 10 (10,000 ppm of Mo).

The study was completed by the analysis of the thermal transformation in a wider severity range. Similar results are observed for JE 55 and JE 74, apart from a reduction of the coke level from 2.2 to 1%, signifying that the preferred action range of pyrene is beyond 50% conversion (Y500).

TABLE II

| | Invention JE115 | Comparative SD10 | Invention JE74 | Comparative JE55 |
|---|---|---|---|---|
| Conditions: | | | | |
| pyrene (%) | 10 | 0 | 10 | 0 |
| PMA (ppm Mo) | 1400 | 10000 | 1400 | 1400 |
| Initial P H2 (25° C.) (MPa) | 7.5 | 7.5 | 7.5 | 7.5 |
| Temperature (°C.) | 430 | 440 | 430 | 430 |
| Residence time (mn) | 180 | 180 | 60 | 60 |
| Weight balance (pyrene deducted): | | | | |
| G (%) | 9.6 | 14.3 | 6.1 | 8.4 |
| L (%) | 84.3 | 80.2 | 92.9 | 89.4 |
| C (%) | 6.1 | 5.5 | 1.0 | 2.2 |
| Conversions (pyrene deducted): | | | | |
| Y500 (%) | 77.9 | 81.3 | 47.2 | 49.6 |
| Y650 (%) | 80.2 | 81.7 | 61.4 | 61.5 |
| Liquid quality (pyrene deducted) | | | | |
| Quantity of 500 (%) | 82.1 | 85.1 | 46.5 | 46.7 |
| Cr (%) | 2.4 | 2.8 | 12.8 | 12.6 |
| H/C at | 1.40 | 1.55 | 1.37 | 1.43 |

In table III, the temperature was increased. The comparison of the effluents of JE 86 (10% pyrene) and JE 81 confirms the specific activity of the pair PMA-pyrene with in particular a reduction of the coke level from 13.5 to 5.9% and significant increases of Y650 (from 68.2 to 79%).

The influence of the change from 10 to 20% pyrene (JE 112) at 440° C. is substantially the same as at 430° C. and would appear to confirm that a limited pyrene quantity is preferable under low severity conditions. However, the use of a larger additive quantity has, in deep conversion, a positive action (440° C.—3 hours—JE 119).

TABLE III

| | Comparative | Invention | | |
|---|---|---|---|---|
| | JE81 | JE86 | JE112 | JE119 |
| Conditions: | | | | |
| pyrene (%) | 0 | 10 | 20 | 20 |
| PMA (ppm Mo) | 1400 | 1400 | 1400 | 1400 |
| Initial P H2 (25 ° C.) (MPa) | 7.5 | 7.5 | 7.5 | 7.5 |
| Temperature (°C.) | 440 | 440 | 440 | 440 |
| Residence time (mn) | 120 | 120 | 120 | 180 |
| Weight balance (pyrene deducted): | | | | |
| G (%) | 13.2 | 11.4 | 20.5 | 22.0 |
| L (%) | 73.3 | 82.7 | 73.0 | 73.4 |
| C (%) | 13.5 | 5.9 | 6.5 | 4.6 |
| Conversions (pyrene deducted): | | | | |
| Y500 (%) | 73.6 | 75.6 | 72.5 | 82.4 |
| Y650 (%) | 68.2 | 79.0 | 74.6 | 83 |
| Liquid quality (pyrene deducted): | | | | |
| Quantity of 500 (%) | 84.2 | 78.8 | 72.8 | 83.3 |
| Cr (%) | 2.6 | 3.0 | 5.3 | 2.8 |
| H/C at | 1.43 | 1.46 | 1.45 | 1.46 |

Table IV gives the results relating to the temperature severity rise, compared with a conversion in the absence of catalyst and additive on the one hand and a conversion in the presence of a catalyst and in the absence of an additive on the other.

For a higher severity level, the conversion of the heavy fractions 650+increases (whereas it decreases in the comparative test) with a very acceptable coke level. Moreover, at high severity levels, the effect of the combination of 1400 ppm of Mo and 20% pyrene is very close to the action obtained by 5000 and 10,000 ppm of Mo alone.

TABLE IV

| | Comparative | | Comparative | | Invention | |
|---|---|---|---|---|---|---|
| | JE78 | SD14 | JE65 | JE81 | JE76 | JE86 |
| Conditions: | | | | | | |
| pyrene (%) | 0 | 0 | 0 | 0 | 10 | 10 |
| PMA (ppm Mo) | 0 | 0 | 1400 | 1400 | 1400 | 1400 |
| Initial P H2 (25° C.) (MPa) | 7.5 | 7.5 | 7.5 | 7.5 | 7.5 | 7.5 |
| Temperature (°C.) | 430 | 440 | 430 | 440 | 430 | 440 |
| Residence time (mn) | 120 | 120 | 120 | 120 | 120 | 120 |
| Weight balance (pyrene deducted): | | | | | | |
| G (%) | 14.7 | 12.7 | 10 | 13.2 | 9.5 | 11.4 |
| L (%) | 69.9 | 70.1 | 83 | 73.3 | 87.9 | 82.7 |
| C (%) | 15.4 | 17.2 | 7 | 13.5 | 2.6 | 5.9 |
| Conversions (pyrene deducted): | | | | | | |
| Y500 (%) | 65.2 | 75.0 | 68.7 | 73.6 | 65.8 | 75.6 |
| Y650 (%) | 59.5 | 57.4 | 75.7 | 68.2 | 77.6 | 79 |
| Liquid quality (pyrene deducted): | | | | | | |
| Quantity of 500 (%) | 75.3 | 91.9 | 73.10 | 84.2 | 65.7 | 78.8 |
| Cr (%) | 4.4 | 3.3 | 3.7 | 2.6 | 6.4 | 3.0 |
| H/C at | 1.42 | 2 | 1.45 | 1.43 | 1.37 | 1.46 |

Table VI shows the results obtained when replacing pyrene by a "catalytic slurry", i.e. a heavy liquid phase resulting from the catalytic cracking process forming part, like LCO (Light Cycle Oil) and HCO (Heavy Cycle Oil) of the unconverted products.

This highly aromatic fraction initially contains fine catalyst particles (aluminosilicates). The decanted catalytic slurry used in this study contains a very high percentage of aromatic molecules (more than 80% measured by the Sara method). Its atomic H/C ratio is 1.05. The operating conditions for the catalytic cracking means that it has already undergone a significant dealkylation, which makes it relatively thermally insensitive (homolytic breaks of the C—C bonds discouraged by the short chains). By comparison with pyrene, the main characteristics are given in Table V.

TABLE V

Characteristics of the slurry and pyrene.

| | Slurry | Pyrene |
|---|---|---|
| General characteristics | | |
| % H | 7.75 | 4.94 |
| % C | 88.50 | 95.06 |
| % S | 3.40 | |
| % N | 0.25 | |
| H/C at | 1.05 | 0.62 |
| SARA analysis | | |
| saturated product % | 12.1 | |
| olefin % | 0.3 | |
| aromatics % | 82.7 | |
| resins % | 2.1 | |
| n-$C_7$ asphaltenes % | 2.8 | |
| Pyroanalysis | | |
| % 500 | 89.7 | 100 |
| % 650 | 92.3 | |
| % CR | 1 | |

On the basis of the above data, it is possible to contend that the slurry is mainly constituted by polyaromatics having 3 to 5 nuclei substituted by short chain alkyls. The results suggest a considerable similarity of activity between the two additives, thus confirming the possibility of replacing the pyrene by slurry. From a process standpoint, the PMA-catalytic slurry combination makes it possible to reduce the catalyst content and should be taken into account from the economic standpoint. Moreover, it makes it possible to valorize a heavy phase (slurry) not used up to now.

TABLE VI

| | JE127 | JE138 |
|---|---|---|
| Conditions: | | |
| Slurry (%) | 20 | 30 |
| PMA (ppm Mo) | 1400 | 1400 |
| Initial P H2 (25° C.) (MPa) | 7.5 | 7.5 |
| Temperature (°C.) | 440 | 440 |
| Residence time (mn) | 120 | 120 |
| Weight balance (additive deducted): | | |
| G (%) | 19.1 | 12.3 |
| L (%) | 72.7 | 81.9 |
| C (%) | 8.2 | 5.8 |
| Conversions (additive deducted): | | |
| Y500 (%) | 77.1 | 76.7 |
| Y630 (%) | 76.2 | 77.9 |
| Liquid quality (additive deducted): | | |
| Qantity of 500 (%) | 81.0 | 79.8 |
| Cr (%) | 2.6 | 4.5 |

TABLE VI-continued

| | JE127 | JE138 |
|---|---|---|
| H/C at | 1.39 | 1.25 |

The above examples confirm that the additive does not merely function as a hydrogen donor. The results obtained are unexpected.

It is considered that dihydropyrene (produced by pyrene under hydrogenating conditions) permits the stabilization of the radicals by radical trapping, but also by dehydrogenation frees the reactive hydrogen atoms in the medium ensuring an activation of the molecular hydrogen. The molecules grafted by the pyrenyl radicals would fragment under more severe conditions and would then be converted. The coke precursors would consequently be provisionally immobilized under conditions where coke could form.

Another aspect that is important is the interaction between the liquid additive, e.g. pyrene, at the pyrolysis temperature and the heavy fraction remaining to be converted and the catalyst grains (a few microns). During the conversion, a large part of the petrol is transformed into a light distillate, (whereof a good part passes into the gas phase) and no longer constitutes a dispersing medium for large asphaltene aggregates remaining to be converted, this probably leading to intermolecular condensation reactions. The pyrene then becomes the suspending medium for said heavy fractions and the catalyst and can therefore act up to the final conversion stage in synergism with the catalyst.

We claim:

1. A process for the liquid phase hydroconversion to lighter hydrocarbons of a hydrocarbon charge containing heavy fractions having a boiling point exceeding 370° C., said process comprising contacting the charge with 50 to 5000 ppm, based on the charge, of a dispersed catalyst comprising at least one hydrogenating metal sulfide generated in the charge from a precursor, and adding at a rate of 5 to 60% by weight based on the charge at least one non-hydrogen donating polyaromatic additive having a boiling point between 300° and 550° C. and having at least three aromatic rings and maintaining the pressure above 3.5 MPa and the temperature at least 400° C. for a time sufficient to convert at least 50% by weight of the heavy fractions to lighter hydrocarbons.

2. A process according to claim 1, wherein the metal is at least one metal of group IV B, V B, VI B, VII B and VIII.

3. A process according to claim 1, wherein the metal is molybdenum, nickel or cobalt.

4. A process according to claim 1, wherein the catalyst comprises at least two metals.

5. A process according to claim 1, wherein the additive is pyrene, fluoroanthene, anthracene, benzanthracene, dibenzanthracene, perylene, coronene or benzopyrene, each optionally substituted by lower alkyl, or a petroleum fraction having a boiling point between 300° and 550° C.

6. A process according to claim 1, wherein the additive is a liquid phase slurry resulting from catalytic cracking and which has been decanted.

7. A process according to claim 1, in which at least 70% of the heavy fractions with a boiling point above 500° C. are converted into fractions with a boiling point below 500° C., wherein the temperature is equal to or above 430° C. and the pressure is at least 5 MPa.

8. A process according to claim 1, wherein the temperature is between 430° and 450° C.

9. A process according to claim 1, wherein the pressure is between 10 and 15 MPa.

10. A process according to claim 1, wherein the catalyst comprises nickel and molybdenum.

11. A process according to claim 1, wherein the catalyst comprises cobalt and molybdenum.

12. A process according to claim 1, wherein the additive has at least four aromatic rings.

13. A process according to claim 1, wherein the additive is pyrene, fluoroanthene, anthracene, benzanthracene, dibenzanthracene, perylene, coronene, or benzopyrene, each optionally substituted by lower alkyl.

* * * * *